United States Patent [19]

Hotchkiss

[11] 4,411,374

[45] Oct. 25, 1983

[54] TISSUE DISPENSER SYSTEM, PLASTIC OVERWRAP PACKAGE THEREFOR

[75] Inventor: Harry W. Hotchkiss, Neenah, Wis.

[73] Assignee: Kimberly-Clark Corporation, Neenah, Wis.

[21] Appl. No.: 289,819

[22] Filed: Aug. 3, 1981

[51] Int. Cl.[3] ..... B65H 1/00

[52] U.S. Cl. ..... 221/63; 221/46; 221/47; 221/45

[58] Field of Search ..... 221/45, 46, 63, 64, 221/65, 34, 35, 36, 37, 38, 39, 40, 41, 42, 43, 44, 47, 48, 50, 51, 52, 53, 54, 55, 56, 57, 58, 59, 60, 61, 62; 150/1, 50; 229/53, 55

[56] References Cited

U.S. PATENT DOCUMENTS

| | | | |
|---|---|---|---|
| 2,840,268 | 6/1958 | Casey et al. . | |
| 3,369,698 | 2/1968 | Scholtz . | |
| 3,369,699 | 2/1968 | Enloe . | |
| 3,970,215 | 7/1976 | McLaren et al. | 221/45 |
| 3,986,479 | 10/1976 | Bonk | 221/47 X |
| 4,262,816 | 4/1981 | Margulies | 221/63 X |

*Primary Examiner*—Joseph J. Rolla

*Assistant Examiner*—Jan Koniarek

*Attorney, Agent, or Firm*—W. K. Fredericks; R. Jonathan Peters; P. A. Leipold

[57] ABSTRACT

Tissue dispensing system for dispensing a stack of interleaved facial tissues from a wall mounted type dispensing cabinet employs a plastic overwrap package of facial tissues having a perforated opening which automatically adheres a front face of the package to a slot in the cabinet to provide inproved tissue dispensing. As each tissue is dispensed, tensile forces are applied to the front face of the package along defined lines by the edges of the tissue passing past the corners of the opening in the package causing the front face of the package to bend into a truncated, hip-roof shaped structure having the truncated end depending from the slot in the cabinet. The tensile forces on the front face cause compressive forces to be applied about a perimeter region situated between the outer extremes of the front face and the outer extremes of a back face of the package in a sense opposing movement of the stack of tissues away from the back face of the package as the stack of tissue diminishes and in a manner preventing collapse of the plastic package during dispensing of the tissues.

5 Claims, 19 Drawing Figures

TISSUE DISPENSER SYSTEM, PLASTIC OVERWRAP PACKAGE THEREFOR

BACKGROUND OF THE INVENTION

1. Field of the Invention

The present invention relates generally to tissue dispensing apparatus, and particularly to plastic overwrap packages of facial tissues of a novel form capable of effecting interleaved tissue dispensing from wall-mounted type dispensing cabinets.

2. Description of the Prior Art

In prior art tissue dispensing systems, it is well-known to mount a cardboard carton of "pop-out" type multifolded, multi-ply facial tissues in a wall mounted, tissue dispenser cabinet, to form a tissue dispensing system. Such a system permits tissues to be removed sequentially from a carton through an aperture in the carton and in the cabinet respectively.

To develop efficient "pop-out" sequential dispensing, the prior art teaches making and using a variety of forms of improved cardboard cartons for housing clips or stacks of tissue as well as new folding arrangements of the tissues in the clip. Such carton forming and tissue folding techniques, in most instances, were developed in an attempt to overcome problems associated with interruptions in sequential dispensing of tissues caused mainly by a trailing tissue falling back into the carton after a leading tissue had been removed from the carton. Some of these improved carton packages of tissues are suitable for use in dispenser cabinets.

An illustrative environment where application of the principles of the present invention is particularly advantageous is in tissue dispensing cabinets such as, for example, the cabinet as described in U.S. Pat. No. 2,840,268 to Casey et al dated June 24, 1958. The patent describes a cabinet designed to conveniently hold a standard box of facial tissue. The described cabinet comprises a rectilinear enclosure having mutually-joined panels forming a top, a bottom, two ends and a back and having a face plate covering the rectilinear enclosure. The face plate contains an elongated opening disposed to permit removal of tissues from the box held within the enclosure.

One form of a standard carton for housing facial tissues suitable for use in the aforementioned dispenser cabinet is illustrated in U.S. Pat. No. 3,369,698 to Scholz dated Feb. 20, 1968. The carton, a cardboard container has a pair of opposed side walls, a bottom wall, a pair of opposed end walls and a top wall having a dispensing slot through which a leading edge of a tissue is threaded, the leading edge of the threaded tissue can be gripped and easily removed. The described carton contains a clip or stack of interleaved, unconnected, multi-ply tissues arranged for sequential dispensing through the dispensing slot. The tissues usually comprise a unitary structure made up of at least two plies of thin, lightweight, absorbent, creped cellulosic sheet material. In the conventional interleaving arrangement of the clip for tissue dispensing, a portion of the first half of the leading tissue protrudes through the dispensing slot while the second half remains on the stack within a medial fold of the next tissue in the stack. When the leading tissue is pulled through the dispensing slot, the first half of the next tissue follows the second half of the leading tissue through the dispensing slot. Normally, this mode of tissue dispensing can be readily accomplished, particularly when the carton is more than half full of tissues. However, as the stack of tissues is depleted, the span of travel from tissue stack to dispensing slot becomes greater and there is more chance for the first half of the next trailing tissue in the stack to become disengaged from the secondhalf of the leading tissue before entry into the dispensing slot. This disengagement of the tissues is generally referred to as "fallback".

The patent describes a solution to the fall-back problem in disclosing a new type of interleaving arrangement used in the lower half of the tissue stack. The new type of interleaving requires the first half of the trailing tissue to be enclosed between the top and bottom plies of the second half of the leading tissue.

Another prior art dispensing carton which could be used in a dispensing cabinet and which discloses a further means for solving the aforementioned tissue fall-back problem is described in U.S. Pat. No. 3,369,699 to Enloe et al dated February 20, 1968. There, further improvements for solving the fall-back problem is described. The patent teaches increasing the frictional resistance to tissue movement in one direction for better dispensing control. A pair of lip-like constricting plastic film members through which the inerleaved tissues may be sequentially drawn is fastened to the underside of a top wall and over a truncated elliptical shaped dispensing slot to form a narrow and straight slot having flexible film material disposed in side-by-side relationship.

When the leading tissue is withdrawn from the carton, the first half of the trailing tissue is held ready for withdrawal by being gripped by the constricting plastic members disposed within the dispensing slot. However, because the leading or protruding tissue is weighted down by frictional engagement with the first half of the trailing tissue, the leading tissue tries to slide back into the carton. In most cases, the gripping force exerted on the protruding tissue by the constricting flexible lips of the narrow slow is sufficient to hold the tissue from falling back into the carton onto the stack even though the downward gravitational force exerted by the sliding action and weight on the trailing tissues cause the flexible lips of material to arc backward within the carton. However, when the level of tissues in the stack becomes low, the backward force exerted on the leading tissue gradually increases until such force is sufficient to exceed the gripping force of the constricting lips in the dispensing slot causing fall back to occur. The patent describes an inventive solution to this fall-back problem; namely it provides means of increasing the coefficient of friction on the upper surface of the film in the areas immediately adjacent to the dispensing slot whereby the leading tissue may be gripped more substantially. The patent describes means for increasing the coefficient of friction in such areas by the application of granular particles to the upper surface of the plastic film or alternatively to provide a number of spaced, upwardly directed punctures in the flexible material.

Another prior art regular size or carton size package useful for tissue dispensing is a plastic film wrapped package of tissues. One such film wrapped package is comprised of a fin sealed band of 1 mil thick, high density cellophane with the ends of the band pinch sealed to form small flaps at each end of the package. To gain entry of the package in order to remove the tissue from a "c-fold" tissue clip, a perforated line is provided which extends the full length of the package. Such a package is not, probably, very suitable for dispensing tissues from a dispensing cabinet since there appears to be no structural provisions provided that would permit such utilization.

As is apparent from the foregoing descriptions of the prior art rather extensive modifications to the carton package or to the stack of tissues are needed to form an improved dispensing carton system suitable for use in a wall-mounted cabinet dispenser. A search for various other means to avoid the fall-back problem as well as to provide a better dispensing package for use in a wall dispenser cabinet was initiated. This search was successful and resulted in the present invention.

The present invention is directed to the improved product which resulted from confronting and solving the basic fall-back problem as described above. In the course of the development, additional unforseen problems were also solved as will be apparent.

BRIEF SUMMARY OF THE INVENTION

The present invention relates to a dispensing system for dispensing a stack of interleaved facial tissues packaged in a plastic overwrap from a wall mounted type dispensing cabinet. The plastic wrapped package has a perforated opening in a front face of the package. During dispensing the edges of the opening curl about a dispensing slot in the cabinet effecting mechanical cleaving of the package to the cabinet. As the tissues pass through the curled opening, the edges of the tissues exert tensile forces along defined lines in the front face of the package causing formation of a truncated nip roof shaped front face, the truncated portion connected to and protruding from the dispensing slot. The protruding front face joins a back face of the package along a perimeter region including the outer extremities of the backface. The tensile forces on the front face cause compressive forces to be applied about the perimeter region in a sense opposing movement of the stack of tissues away from the back face of the package as the stack of tissues is depleted and in a manner preventing collapse of the front face of the plastic package during tissue dispensing. The backface of the package includes a region of an overlapped band joined with sealed end surfaces of the package to form a I-shaped plastic strut in the material to provide in a sense rigidity to the backface to support the stack of tissues and prevent collapse of the backface of the package while the package of tissues is mounted in the dispensing cabinet.

BRIEF DESCRIPTION OF THE DRAWINGS

Referring to the drawing figures, in which like numerals represent like parts in the several views.

DETAILED DESCRIPTION OF THE PREFERRED EMBODIMENT

Figure 1:
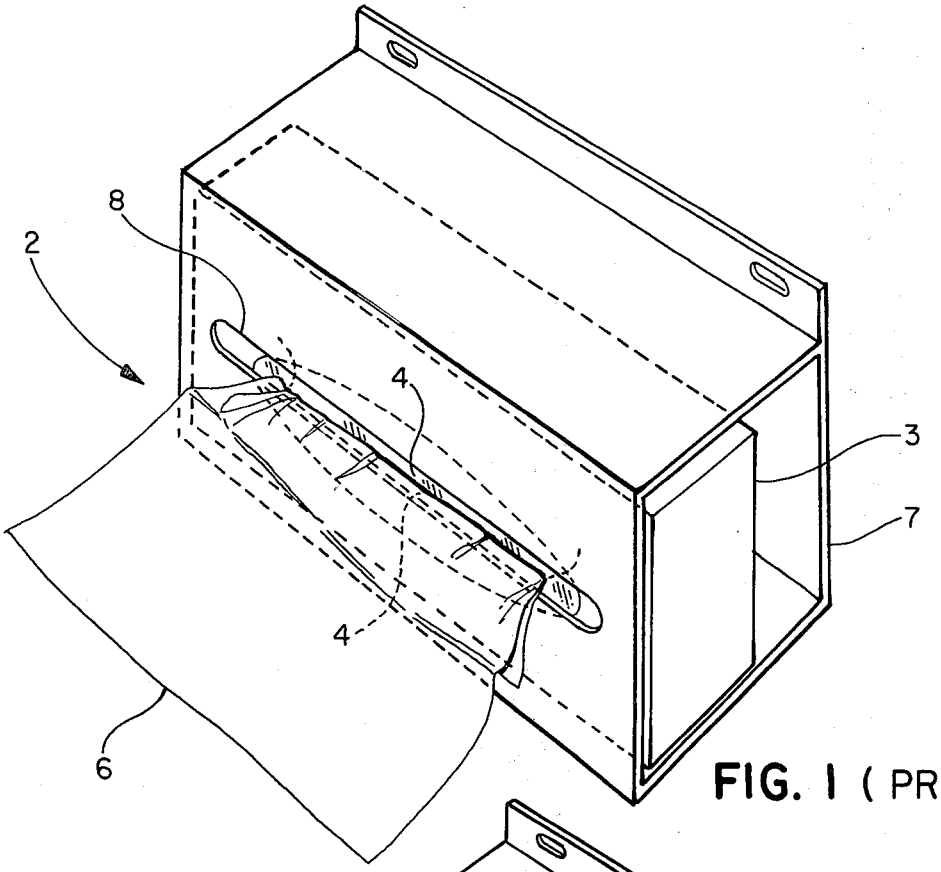
FIG. 1 ( PRIOR ART )
FIG. 1 is a prior art tissue dispensing system that includes a cardboard carton of facial tissues.
Figure 2:
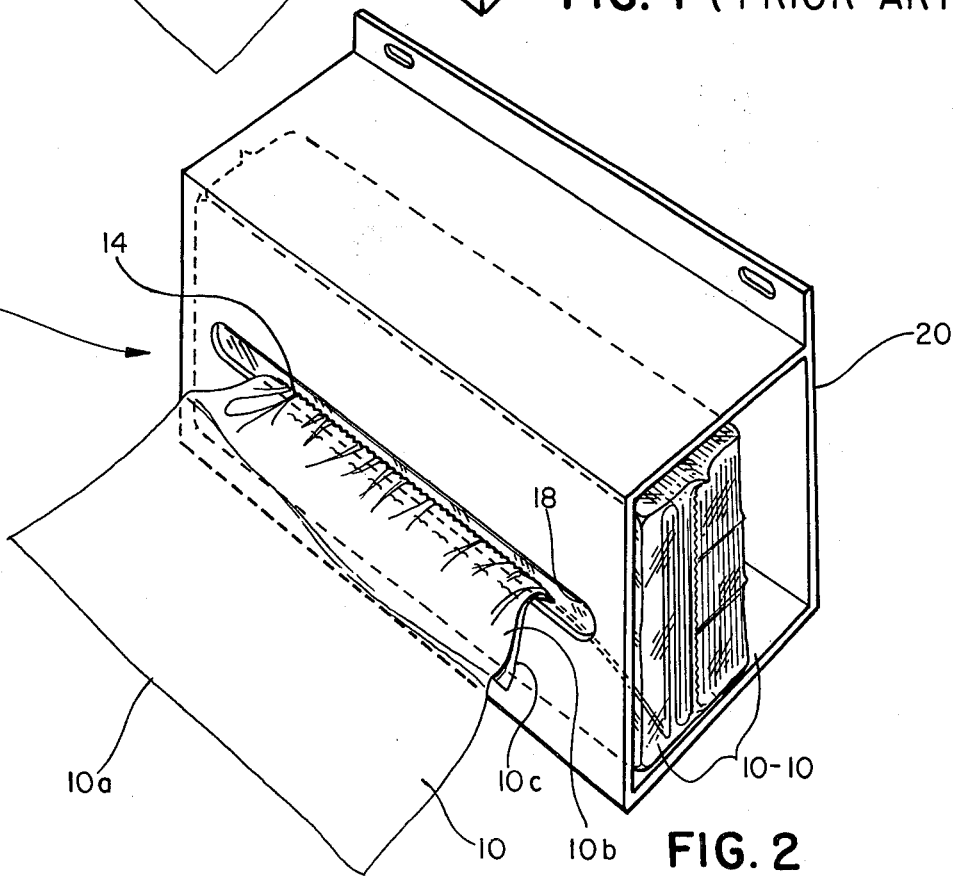
FIG. 2 is a perspective view of a preferred embodiment of the plastic overwrap package of this invention.

Referring to the drawing figures, there is shown in FIG. 1 a prior art tissue dispensing system 2 that includes a cardboard carton 3 containing facial tissues. A leading tissue 6 from the stack of tissues (not shown) in the carton protrudes from the carton through the constricting lips 4—4 of carton 3 and the dispensing slot 8 of a wall-mounted type cabinet dispenser 7. Such a system works well as long as the carton 3 remains positioned near the front portion of the cabinet and the stack of tissues remains upright in the carton. If there is movement of the carton away from the front of the cabinet, then the leading tissues, when withdrawn from the carton may be abraded or even torn as the surface of the tissues passes over the edge of the dispensing slot 8 of the dispenser cabinet. The fibers of the tissues can become scuffed, forming not only a weakened tissue 6 but also undesirable dust particles. If the depth of the cabinet is much greater than the depth of the carton, and then if the carton is moved to the back portion of the dispenser cabinet, then sequential dispensing of tissues may become impossible due to the fact that the protruding tissues may protrude from the carton but may not protrude far enough to permit exiting through the dispensing slot of the dispensing cabinet.

To provide a package of tissues which interrelates with a dispensing cabinet, a preferred embodiment of a tissue dispensing system depicted in FIG. 2–FIG. 4*d*. A first half 10*a* of a leading tissue 10 to be dispensed from a stack or clip of multi-folded tissues 10—10 is threaded through a perforated opening 14, of a chosen length, in a film overwrap 16; and then the tissue is further threaded through a dispensing slot 18 in a face plate of a dispenser cabinet 20. The dispensing slot generally has a length greater than the length of the perforated openings.

The tissues 10—10 in the clip are interleaved in the conventional manner used to provide the automatic "pop-out" tissue dispensing feature which is well-known in the art. A first half 10*c* of a medial folded trailing tissue is frictionally engaged to a second half 10*b* of the leading tissue such that when the leading tissue is pulled through opening 14, and slot 18, the first half of the medial folded trailing tissue 10*c* becomes the protruding portion of the next tissue to be dispensed. The folded end of the medial folded tissues (best seen in FIG. 4*a*–4*b*) is alternately disposed within the clip such that, if the folded edge 10*f* of FIG. 4*a* of the trailing tissue appears at the top edge of the clip, then the folded edge 10*f* of FIG. 4*b* of the next trailing tissue will appear at the bottom edge of the clip.

Figure 5A:
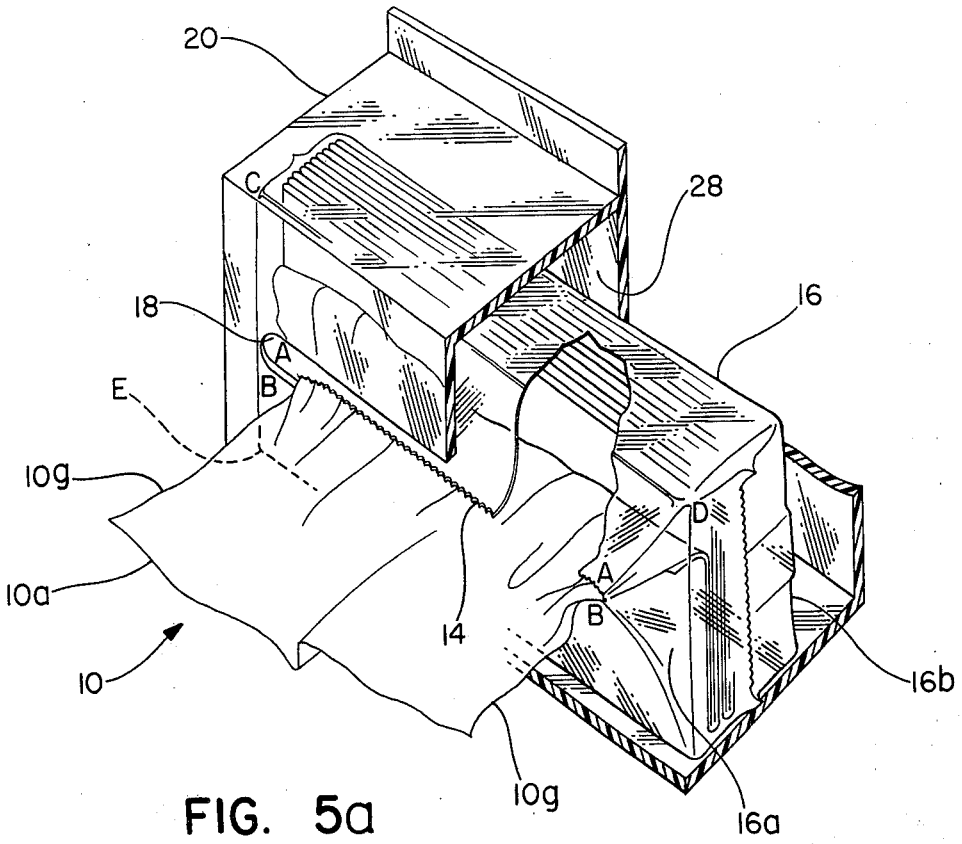
FIG. 5*a*–5*c* is comprised of several perspective views, illustrating the formation of the truncated hip roof shaped, front face of the package.
Figure 5B:
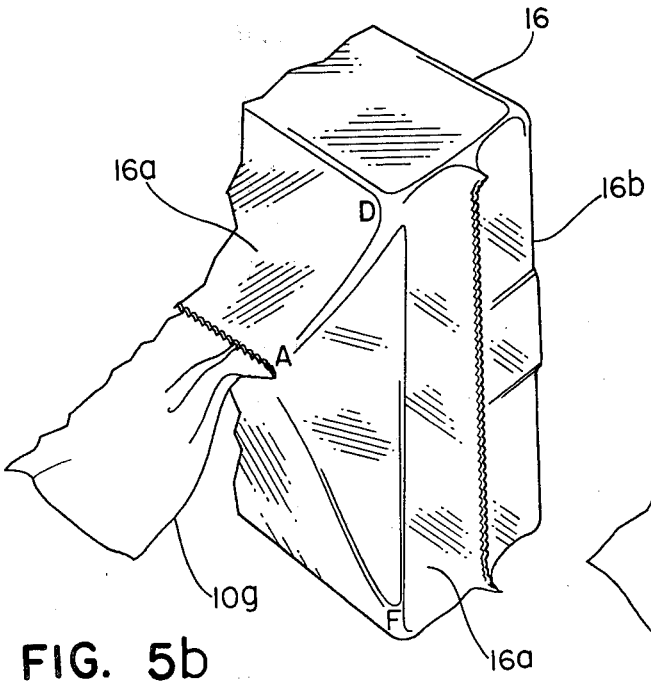
Figure 5C:
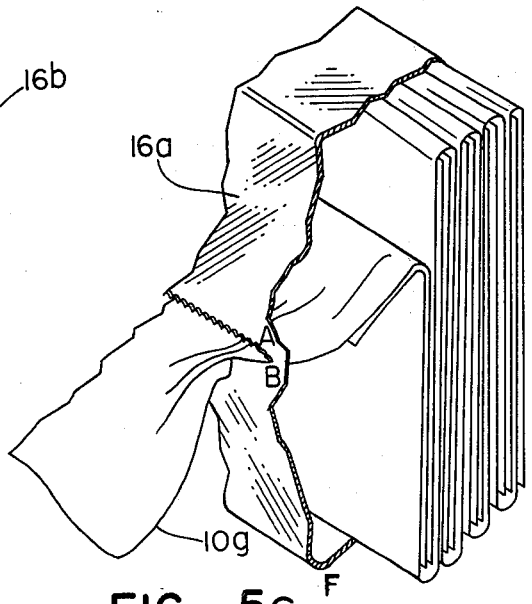
Figure 6A:
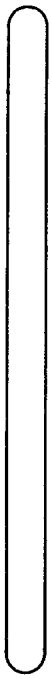
FIG. 6*a*–6*d* is comprised of several plan views, FIG. 6*a*–6*d*, of shapes of dispensing slots in the dispensing cabinet of this invention.
Figure 6B:
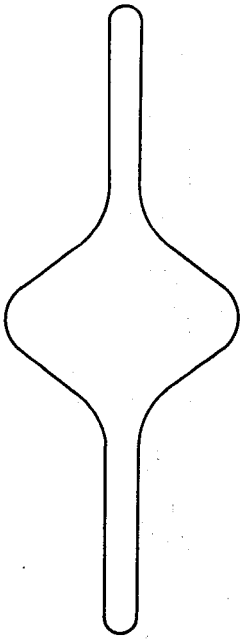
Figure 6C:
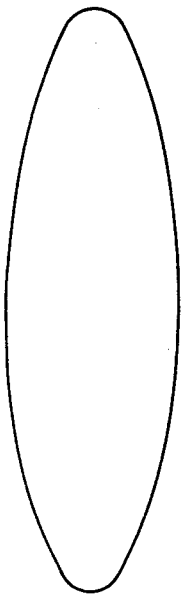
Figure 6D:
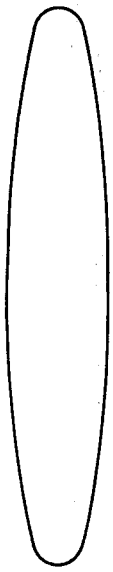

As the front half of the leading tissue is pulled through the opening 14 and slot 18, the outer edges 10*g*—10*g* of FIG. 5*b* of the second half of the leading tissue curl downward from the corners A—A of the opening 14. The downward curled edges 10*g*–10*g* apply a first tensile force upon the front surface of package 16 along the lines A C and A D. This first tensile force in turn causes a first compressive force to occur along the line between C and D.

As the aforementioned downward curling of the second half of the leading tissue is occuring, the first half of the trailing tissue is pulled through the opening 14 and the slot 18. The outer edges 10*g*–10*g* of the first half of the trailing tissue curl upward from the bottom corners B—B of the opening 14. The upward curled edges 10g–10g apply a tensile force upon the front surface of package 16 along the lines B E and B F. This second tensile force in turn causes a second compressive force to occur along the line between E and F.

These tensile and compressive forces upon package 16 tend to rearrange the front surface 16a into a truncated hip roof shaped surface which extends away from the opening 14 in a manner much like a funnel. It is believed these compressive forces occurring about the perimeter which includes the points C D E and F tend to prevent the front half of the package 16 from collapsing. Also, it is believed these compressive forces tend to hold the clip upright and in place against the back face of the package as the clip is gradually depleted.

Figure 3A:
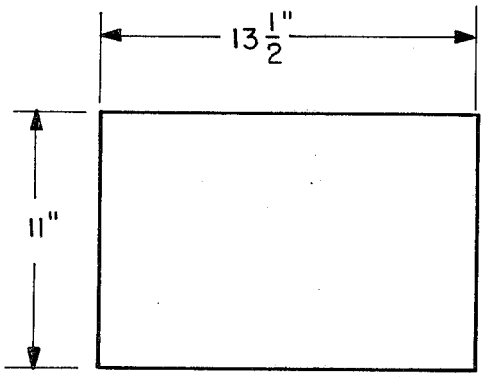
FIG. 3*a*–3*f* is comprised of several plan and perspective views, illustrating the steps required for constructing the preferred embodiment of the package shown in FIG. 2.
Figure 3B:
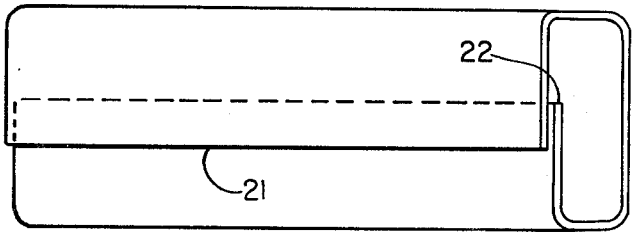
Figure 3C:
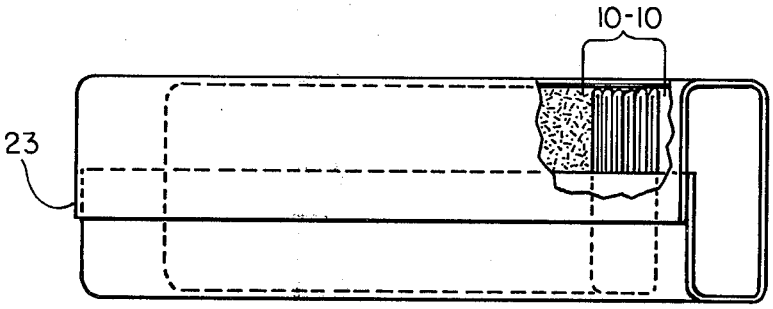
Figure 3D:
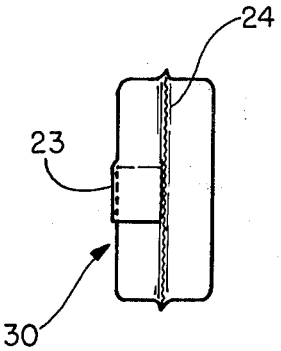
Figure 3E:
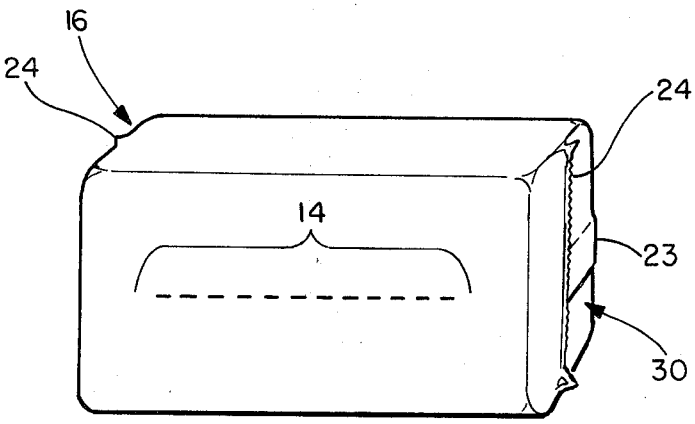

The backface 16b of the package 16 includes a I-shaped, plastic strut 30 formed by a sealed seam 23 best seen in FIG. 3e extending the length of the package and the two side seals 24—24 extending the width of the package. The strut 30 provides a structural strength to the backface of the package which prevents the backface of package 16 from collapsing. The strut 30 cooperatively interacts with the compressive forces originating from the truncated hip roof shape front face to provide a structure which extends away from the slot 18 of the dispensing cabinet and which maintains the clip upright and steady until the last tissue is removed from package 16.

The construction of the package 16 is illustrated in a series of figures, namely, FIG. 3a–3f. The film overwrap package 16 is, in the preferred embodiment, a 1.5 mil thick, 13 ½×11 inches sheet of medium density polyethylene material as shown in FIG. 3a. Overwrap 16 is formed by overlapping a first longitudinal edge 21 of the 13 ½×11 inches sheet of polyethylene material over a second longitudinal edge 22; then, the overlapped region is fused by a conventional hot element heating means (not shown) to form a band having the sealed seam 23 as shown in FIG. 3c. The clip of facial tissues 10—10, illustratively a stack of 150 multi-ply sheets is inserted between the band (see FIG. 13c). The clip is centered within the band as shown; then the ends of the band are folded over, mated and hot wire sealed, by conventional means along the edge 24 at both ends as shown in FIG. 3d. A perforated line 14, best seen in FIG. 3c, of a chosen length is made on the front surface of package 16 such that the perforations can be broken to form the narrow dispensing opening.

Although the above forementioned package forming steps are described as a manual procedure, the entire package operation can be formed using conventional automatic wrapping equipment. If such equipment is used, the perforated line 14 is normally performed prior to forming the band shown in FIG. 3b. Also the ends of the package can be formed by folding the band about the clip and heat sealing the folded ends together.

Figure 3F:
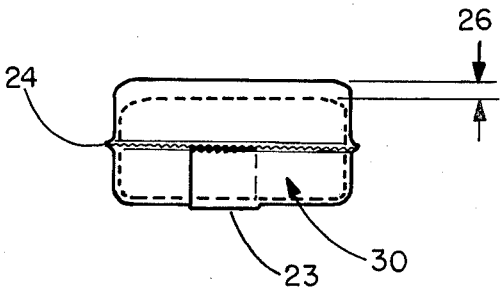

The prefered embodiment of the film overwrap package 16, which contains a clip of 150 count, multi-ply facial tissues, is illustratively 9¼ inches long, 4¾ inches high and 2 inches deep. The perforated line 14 is centered lengthwise on the front face of the package 16 and has a length which is about 60–80% of the length of the package. Illustratively, the length of the perforation is 7 inches long. Also an initial airgap 26 of FIG. 3f is provided to permit improved tissue dispensing and for affecting interrelating the package 16 to the cabinet 20. This initial air gap region is approximately 12% of the total height of the package. Illustratively, the initial air gap region above the clip 10–10 in the package 16 is ¼ inch in height. This air gap region expands as the clip is depleted and becomes the truncated hip roof shaped front surface of package 16. Film thickness may vary from 1.2–2 mil.

The operation of system 12 will now be discussed. The overwrapped package 16 of FIG. 5a which may contain a tissue count of from 100–200 tissues is opened along the perforated opening 14 and the first half 10a of the leading tissue 10 is pulled from the clip. The opened package is inserted in the cavity 28 of dispenser cabinet 20, and the first half 10a of the tissue 10 is threaded through the dispensing slot 18 of the cabinet.

Figure 4A:
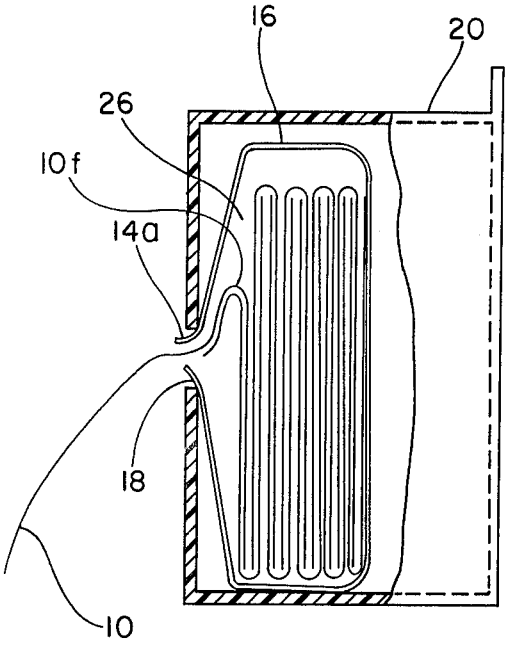
FIG. 4*a*–4*d* is comprised of several plan view functional diagrams, illustrating various interrelations between the package, the tissues being dispensed and a dispensing cabinet.
Figure 4B:
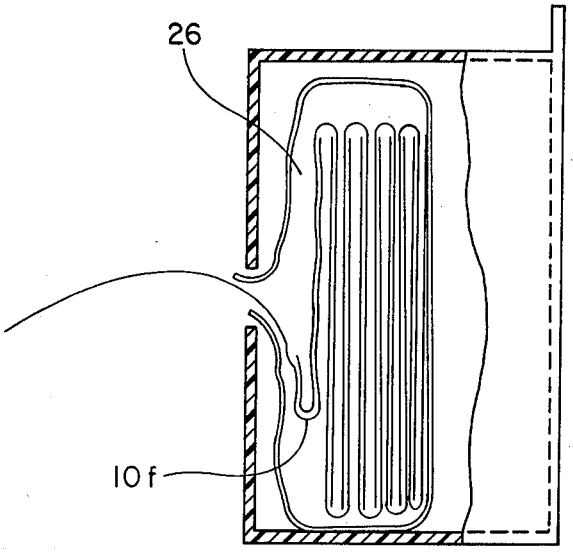

As shown in FIG. 4a in exaggerated form in order to illustrate the features of the invention, where the leading tissue 10 is shown pulled from the interleaved stack, the first edge 14a of perforated line 14 partially curls upward about the top edge of the dispensing slot 18 of cabinet 20 to form a smooth surface for the tissues 10—10 to pass over as each tissue is pulled through slot 18. As the lead tissue is removed the first half of the next tissue is partially pulled through slot 18. Air gap region 26 during the initial dispensing of the tissues prevents the front portion of package 16 from adding any undesirable resistive force against the surface of the tissues being withdrawn from the top portion of the clip. If the partial frictional adherence of the leading tissue to the medial folded trailing tissue is broken during withdrawal, fall-back could occur, preventing the initiation of the automatic "pop-out" feature associated with multi-fold clips. Also, the airgap region 26 provides enough of the film structure of package 26 to permit edges 14a and 14b to partially curl about the dispensing edge 18 of cabinet 20 as the tissues are dispensed. After the leading tissue is dispensed, the front portion of the package near the air gap regions 26, best seen in FIG. 4b, contracts slightly to permit automatic adjusting of the last half of the protruding tissue with the first half of the trailing tissue, providing assistance in preventing excessive sliding friction to occur between the mating surface.

Figure 4C:
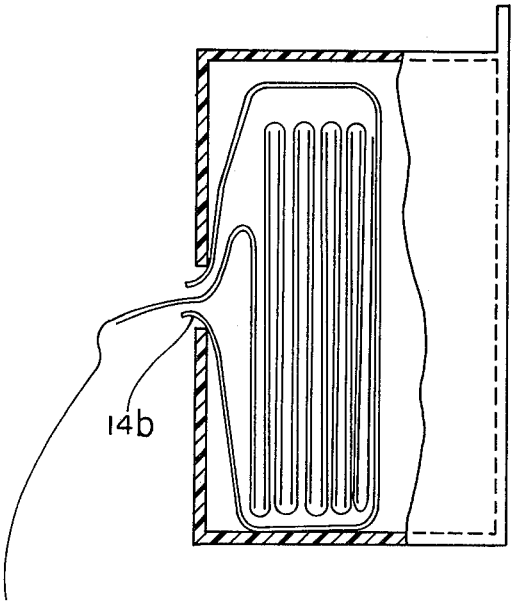
Figure 4D:
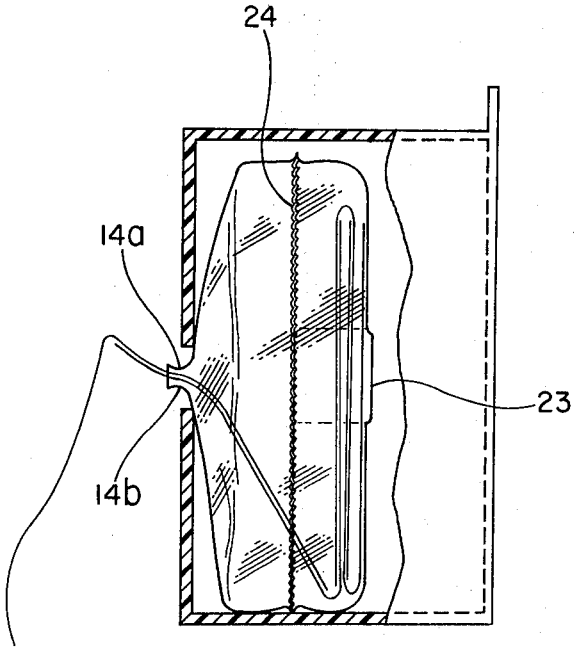

FIG. 4C illustrates how the second edge 14b of the perforated edge 14 curls about the lower edge of dispensing slot 18 as the next tissue is pulled from the clip. With both edges 14a and 14b partially curled about the edges of dispensing slot 18, the perforated edges of the opening are disposed away from the surface of the tissues so as to prevent scraping or abrading tissues as each tissue is removed from the package.

Also, as the front half of the leading tissue is pulled through the opening 14 and slot 18 is respectively the outer edge 10g—10g (best seen in FIG. 5a) of the second half of the leading tissue curl downward from the corners A–D of the opening 14. The downward curled edges 10g—10g apply the first tensile forces upon the front surface of package 16 along the lines A C and A D. This first tensile force in turn causes the first compressive forces to occur along the line between C and D. As the downward curling of the second half of the leading tissue is occurring, the first half of the trailing is being pulled through opening 14 and slot 18. The outer edges 10g—10g of the first half of the trailing tissue applies second tensile forces upward from the bottom corner B—B of the opening 14. The upward curled edges 10g—10g apply the tensile forces upon the front surface of package 16 along the lines BE and BF. These second tensile forces in turn cause the second compressive forces to occur along the line between E and F. These tensile and compressive forces upon package 16 rearrange the front surface 16a into the truncated hip roof shaped surface which extends away from opening 14 and slot 18 in a manner much like the funnel. As the clip is depleted the perimeter CDE and F increases in size and moves towards the back face of the package. The movement of the perimeter of this truncated hip roof shaped front surface 16*a* continues until reaching the bondaries of the side seals forming part of the I-strut 30 of the back face 16*b* of package 16.

As the clip becomes depleted the sealed seam 23 and the sealed ends 24—24 forming the I-shape, plastic strut 30 in the walls of the back face 16*b* of the overwrap package provides structural strength to the back half of the package which prevents the plastic from collapsing, and causing the plastic walls to sag, hindering the dispensing of the interleaved tissues. It is believed the I-shape strut 30 also has the unusual effect of aiding in keeping the nearly deleted clip from collapsing since the clip remains upright and steady until the last tissue is removed from package 16.

Another result which is obtained by using this package is that such a package may be used in virtually any dispenser cabinet even though the depth or width of the cabinets greatly exceeds the depth of the package 16.

This package also has been successfully used in dispenser cabinets having dispensing slots of a variety of configurations such as those illustrated in FIG. 6*a*–6*d*.

It is to be understood that the above described embodiments are mainly illustrative of the principles of the invention. One skilled in the art may make changes and modifications to the embodiments disclosed herein and may devise other embodiments without departing from the scope and the essential characteristics thereof.

What is claimed is:

1. An improved facial tissue dispensing system for dispensing a stack of interleaved tissues from a wall mounted type dispensing cabinet, said cabinet including a vertically disposed face plate having a dispensing slot wherethrough a series of interleaved tissues from the stack disposed perpendicular with respect to the face plate may be sequentially dispensed, said system comprising:

a plastic film overwrap package enclosing the stack of tissues, said package being comprised of (1) a rectangular sheet of plastic material so folded as to overlap for the entire length of said sheet along a central region of a last tissue in the stack forming a band, said band being folded, joined and sealed along the overlap and at both ends of the stack, the seals at the ends of the stack providing side walls about the stack of tissues, the overwrap being disposed to provide an air space region between a front face of the package and a first tissue in the stack; (2) means for forming a narrow dispensing opening disposed lengthwise on the front face of said package said opening being such that the edges of the opening partially curl about the edges of the dispensing slot and mechanically adhere to the slot in a manner resisting movement of said package away from the face plate; the surface of the front face of said package being the type which folds and diverges from said opening to form substantially a truncated hip roof shape extending from said opening as each tissue is dispensed from the stack, the forces of the edges of each tissue on the corners of said opening causing tensile forces to extend across the front face of said package causing compressive forces to be applied between the outer extremes of said front face and the back face of said package opposing movement of the stack of tissues away from the back face as the tissues are dispensed from the cabinet, whereby sequential dispensing of said tissues is improved and collapse of said plastic package is minimized.

2. Apparatus in accordance with claim 1, wherein the overlapped band seal and the end seals form a I-shaped plastic strut within the material of the backface providing a rigidity to the backface which supports the stack of tissues and which prevents collapse of the backface of said package while said package of tissues is mounted in the dispensing cabinet.

3. Apparatus in accordance with claim 2, wherein the plastic material is medium density polyethylene about 1.5 mils thick.

4. Apparatus in accordance with claim 3 wherein said air space region in said package is about 12% of the total height of said package.

5. Apparatus in accordance with claim 4, wherein said opening is a perforated line having length which is about 60–80% of the length of said package; and wherein the length of perforated line is less than the length of the slot within the faceplate of the dispensing cabinet.

* * * * *